United States Patent [19]

Obrecht et al.

[11] Patent Number: 4,930,203

[45] **Date of Patent: * Jun. 5, 1990**

[54] CLINCHING TOOL

[75] Inventors: Robert E. Obrecht, Bloomfield Hills; Edward J. Waltonen, Southfield, both of Mich.

[73] Assignee: Lamb Robo Inc., Bloomfield Hills, Mich.

[ * ] Notice: The portion of the term of this patent subsequent to Feb. 14, 2006 has been disclaimed.

[21] Appl. No.: 310,211

[22] Filed: Feb. 15, 1989

Related U.S. Application Data

[63] Continuation of Ser. No. 901,621, Aug. 29, 1986, Pat. No. 4,803,767.

[51] Int. Cl.[5] ..... B23P 11/00

[52] U.S. Cl. ..... 29/243.5; 29/21.1; 29/509

[58] Field of Search ..... 29/243.5, 243.52, 21.1, 29/509, 522.1, 798, 524.1

[56] References Cited

U.S. PATENT DOCUMENTS

| | | | |
|---|---|---|---|
| 2,811,880 | 11/1957 | Williams | 29/21.1 |
| 3,771,480 | 11/1973 | Johnson | 29/524.1 |
| 3,934,327 | 1/1976 | Hafner | 29/21.1 |
| 4,208,776 | 6/1980 | Schleicher | 29/243.5 |
| 4,459,735 | 7/1984 | Sawdon | 29/243.53 |
| 4,584,753 | 4/1986 | Eckold et al. | 29/243.5 |
| 4,658,502 | 4/1987 | Eckold et al. | 29/522.1 |

*Primary Examiner*—Daniel C. Crane

*Attorney, Agent, or Firm*—Krass and Young

[57] ABSTRACT

A clinching tool including a punch and a die assembly. The die assembly includes a collet, a pin, and a split bushing. The collet includes a lower base portion and upstanding circumferentially spaced spring fingers. The split bushing is received within the spring fingers and the pin passes upwardly through a central passage in the base portion of the collet and is received at its upper end in the split bushing with the upper end of the pin inset with respect to the upper end of the bushing by a distance related to the thickness of materials to be fastened together. The spring fingers of the collet expand during the clinching operation to allow the material of the sheets to flow radially outwardly to form the desired clinching bead. In a further embodiment, the split bushing is dispensed with and the material of the sheets is allowed to flow radially outwardly between the spaced fingers of a collet so as to form a joint having a plurality of circumferentially spaced fingers or spikes. In a further embodiment, the split bushing is dispensed with, the collet is replaced with a rigid steel sleeve, and the material of the steel sleeve is selectively cut away around the upper end of the central sleeve passage to define a plurality of circumferentially spaced clinch openings into which the material of the sheets flows radially during the clinching operation.

5 Claims, 3 Drawing Sheets

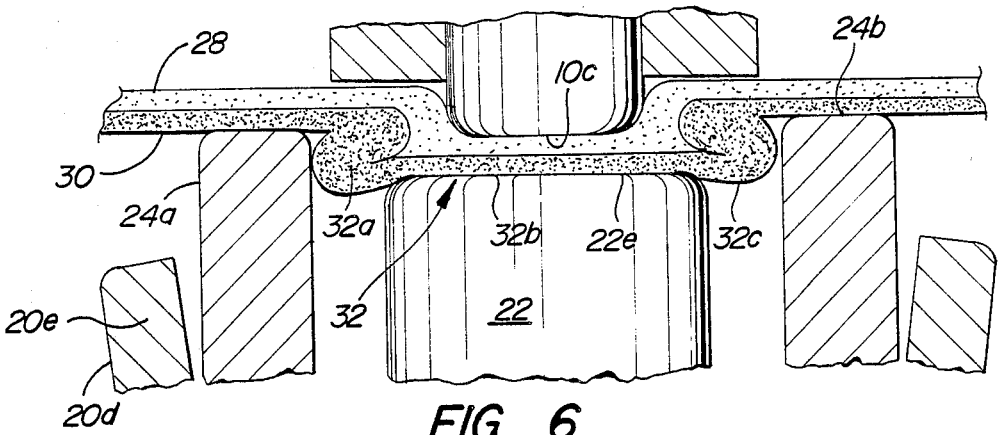
FIG. 6
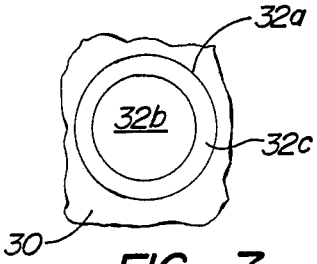
FIG. 7
FIG. 8
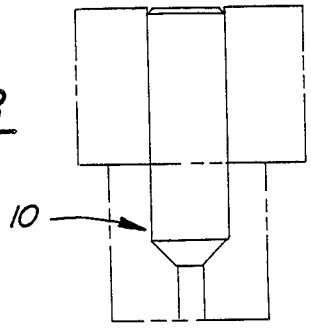
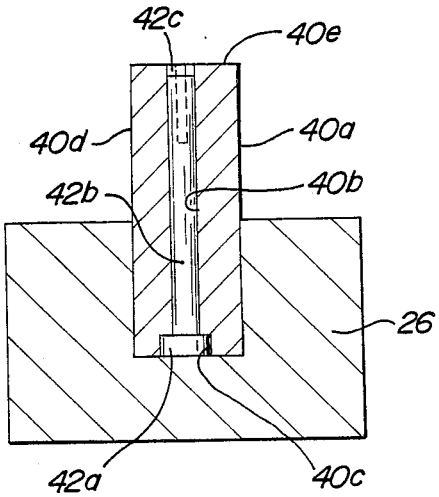
FIG. 9
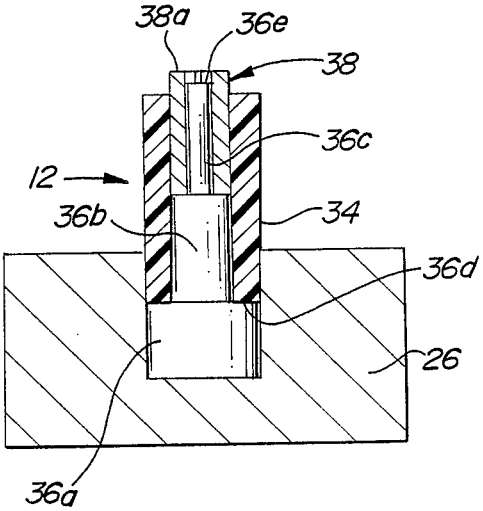
FIG. 11
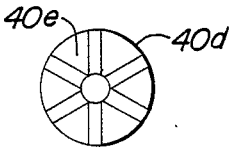
FIG. 10
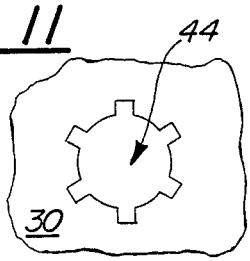

CLINCHING TOOL

This application is a continuation of application Ser. No. 901,621, filed Aug. 29, 1986, now U.S. Pat. No. 48032.

BACKGROUND OF THE INVENTION

This invention relates to tools for fastening two sheets of material together without welding or riveting and, more particularly, to a tool in which the sheets of material are fastened together in a clinching operation.

Sheets of material are most commonly fastened together by the use of welding or by the use of rivets. However, each of these methods has disadvantages. Specifically, welding entails high power requirements and large capital investments and cannot be used to fasten certain dissimilar materials, and riveting also requires high capital investment and produces a rather bulky joint that is unacceptable in many applications. In an effort to overcome the disadvantages of welding and riveting, clinching tools have been developed in which the sheets of material are deformed in a clinching operation to securely join these sheets together without the use of rivets and without the use of welds. Whereas these clinching tools have proven to be generally satisfactory in terms of producing a satisfactory joint as between the sheets of material, the available clinching tools are relatively expensive in original cost and are relatively difficult to repair so that a malfunction of the tool generally requires replacement of the entire tool. Existing clinching tools are also not readily modified to perform different kinds of clinching operations but rather are typically dedicated to a specific clinching operation involving specific materials and specific sheet thicknesses.

SUMMARY OF THE INVENTION

This invention is directed to the provision of a clinching tool which produces a superior clinching joint, is relatively inexpensive to initially manufacture, can be readily modified to adapt to differing applications, and can be readily repaired without necessity to replace the entire tool.

The clinching tool of the invention comprises a punch adapted to be mounted in a punch retainer and a die coacting with the punch. The die includes a tubular member and a pin member. The tubular member is adapted to be mounted in a die retainer in axial alignment with the axis of the punch and defines a central axial passage aligned with the punch axis. The pin member includes a head portion, a shank portion, and an annular transverse shoulder at the juncture of the head and shank portions. The pin member is mounted in the tubular member with the shank portion positioned in the axial passage of the tubular member and with the shoulder of the pin member abutting a transverse annular surface defined adjacent the end of the tubular member remote from the punch. This arrangement allows the pin member to be quickly and positively positioned relative to the tubular member to provide ready assembly of the parts and to precisely position the free end of the shank portion of the pin member relative to the associated end of the tubular member.

In a first embodiment of the invention, the tubular member constitutes an outer tubular member and the tool further includes an inner tubular member which is mounted concentrically within the outer tubular member and is radially expansible to allow radially outward material flow during the clinching operation. This arrangement provides a compact, readily assemblable construction of retaining the inner tubular member and facilitating the radial outward material flow during the clinching operation.

According to a further feature of the first embodiment, the inner tubular member comprises a split bushing. This arrangement provides an inexpensive and readily assemblable means for providing the expansible inner tubular member and allows ready replacement of that member in the event of failure of the member or to tailor the tool to a different clinching requirement.

According to a further feature of the first embodiment, the outer tubular member comprises a collet including a base portion and a plurality of spring fingers extending in cantilever fashion from the base portion in circumferentially spaced relation to the central axial passage of the inner tubular member and including free end portions yieldably engaging circumferentially spaced locations on the inner tubular member. This arrangement provides a convenient and efficient means of mounting and retaining the inner tubular member and functions effectively to allow the radial outward material flow occurring in the course of the clinching operation.

In the second embodiment of the invention, the outer tubular member comprises an annular sleeve formed of a resilient material. This arrangement provides an inexpensive and efficient means of retaining the inner tubular member and accommodating the radial expansion of the inner tubular member and further allows ready repair and replacement of the outer tubular member.

In a third embodiment of the invention, only a single tubular member in the form of a collet is provided. The collet includes a base portion with a central axial passage and a plurality of spring fingers extending in cantiliver fashion from the base portion. The head portion of the pin member is seated in a counterbore in the remote end of the base portion with the shank portion extending upwardly within the collet fingers. This arrangement allows the pin member to be quickly and securely mounted within the collet and provides a convenient means of precisely positioning the free end of the shank portion in its inset relation to the free ends of the collet fingers.

In a fourth embodiment of the invention, the inner tubular member comprises a split bushing, the outer tubular member comprises a sleeve of metallic material, and the die further includes a resilient bushing concentrically interposed between the metallic sleeve and the split bushing to allow the split bushing to resiliently expand during the clinching operation.

In a fifth embodiment of the invention, only a singular tubular member in the form of a metallic sleeve is provided; the portion of the central axial passage adjacent the end of the metallic sleeve adjacent the punch has a diameter matching the diameter of the shank portion of the pin member; and the material of the adjacent end of the metallic sleeve is selectively cut away at circumferentially spaced locations around the central passage to define as circumferentially spaced series of clinch openings into which the material of the sheets of material to be joined together flows in the clinching operation.

BRIEF DESCRIPTION OF THE DRAWINGS

FIG. 6 is a detail view on an enlarged scale showing the material flow occurring during the clinching operation performed by the clinching tool of FIG. 1;

FIG. 7 is a bottom view of a clinch joint formed by the clinching tool of FIG. 1;

FIG. 8 is a somewhat schematic side elevational view in cross section of a second embodiment of a clinching tool according to the invention;

FIG. 9 is a somewhat schematic side elevational view in cross section of a third embodiment of a clinching tool according to the invention;

FIG. 10 is a top view of the clinching tool of FIG. 9;

FIG. 11 is a bottom view of a clinch joint formed by the clinching tool of FIGS. 9 and 10;

DETAILED DESCRIPTION OF THE PREFERRED EMBODIMENT

Figure 1:
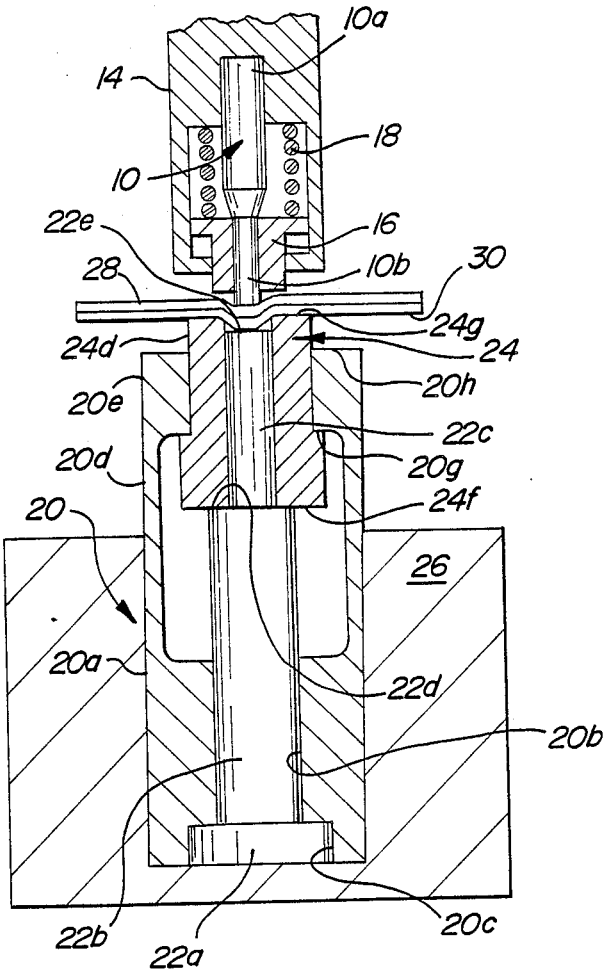
FIG. 1 is a somewhat schematic side elevational view in cross section of a first embodiment of a clinching view in cross section of a first embodiment of a clinching tool according to the invention.
Figure 2:
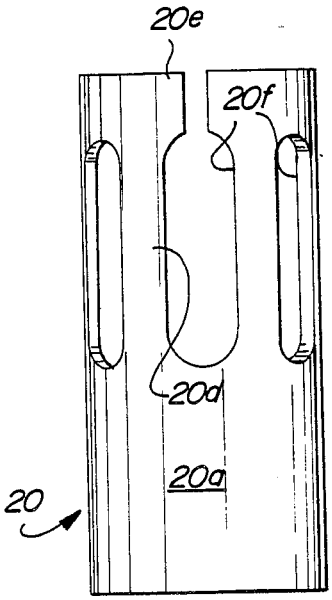
FIG. 2 is a side elevational view of a collet employed in the clinching tool of FIG. 1.
Figure 3:
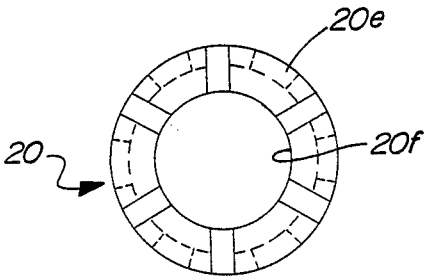
FIG. 3 is a top view of the collet of FIG. 2.
Figure 4:
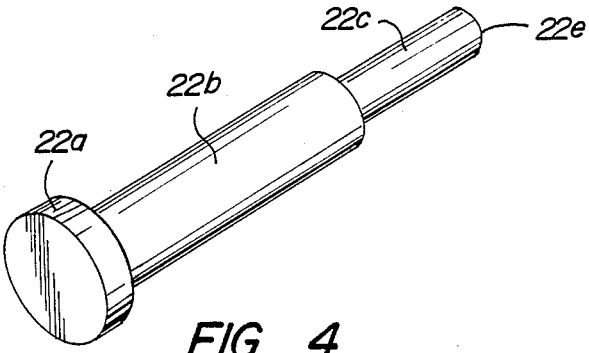
FIG. 4 is a perspective view of a pin employed in the clinching tool of FIG. 1.

The invention clinching tool includes a punch 10 and a die 12. The invention will first be described with reference to the embodiment seen in FIGS. 1–7.

Punch 10 includes a base portion 10*a* suitably held in a punch retainer 14 and a tip portion 10*b*. A stripper 16 is slideably mounted on tip portion 10*b* and urged downwardly by a compression spring 18.

Die 12 is positioned beneath punch 10 in coaxial alignment with the central axis of the punch and includes a collet or collar 20, a pin 22 and a split bushing 24. Collet 20, pin 22, and split bushing 24 are formed of tool steel.

Collet 20 includes a base portion, defining a central axial passage 20*b* and a counterbore 20*c*, and further includes a plurality of upstanding spring fingers 20*d* extending in cantiliver fashion from base portion 20*a* in circumferentially spaced relation to the central axis of the collet and including free end portions 20*e*. Fingers 20*d* are defined by a plurality of circumferentially spaced cutouts 20*f* in the side wall of the collet.

Pin 22 includes a head portion 22*a*, a further reduced diameter head portion 22*b*, and a shank portion 22*c*. Head portion 22*a* is sized to seat in counterbore 20*c* of collet 20; head portion 22*b* is sized to fit in passage 20*b* of collet 20; and shank portion 22*c* has a diameter somewhat greater than the diameter of tip portion 10*b* of punch 10.

Figure 5:
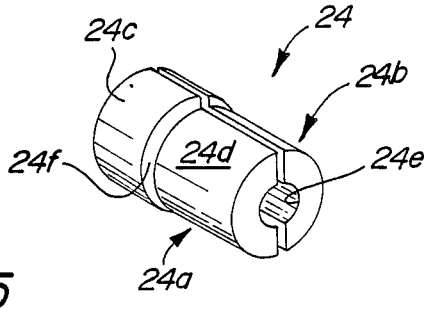
FIG. 5 is a perspective view of a split bushing employed in the clinching tool of FIG. 1.

Split bushing 24 includes two identical halves 24*a* and 24*b*, each including a base portion 24*c* and a shank portion 24*d*. With bushing halves 24*a* and 24*b* fitted together as seen in FIG. 5, they coact to define a central axial passage 24*e* having a diameter approximating the diameter of shank portion 22*c* of pin 22.

The assembled relation of the parts of the die is seen in FIG. 1. Specifically, collet 20 is suitably mounted in a suitable die retainer 26; pin 24 is positioned centrally within collet 20 with head portion 22*a* seated in counterbore 20*c*; head portion 20*b* passing through passage 20*b*; and shank portion 22*c* positioned centrally within fingers 20*e*; and split bushing 24 is positioned on shank portion 22*c* with the lower end 24*f* of the bushing seating on the shoulder 22*d* formed between pin portions 22*b* and 22*c*, the outer surfaces of bushing shank portions 24*d* embraced by the coacting inner surfaces 20*f* of fingers 20*e* of the collet, and the shoulder 24*f* formed between bushing base portions 24*c* and shank portions 24*d* seating against the coacting undersurfaces 20*g* of collet end portions 20*e*. The various axial dimensions of the parts are selected such that split bushing 24 projects above the upper end 20*h* of collet 20 in the assembled relation of the parts and such that the free or upper end 22*e* of pin 22 is inset with respect to the upper end 24*g* of bushing 24 by a distance related to the thickness of the sheet materials 28 and 30 to be joined by the clinching tool.

The operation of the clinching tool of the FIGS. 1–7 embodiment is seen generally in FIG. 1 and in more detail in FIG. 6. As punch 10 is lowered by punch retainer 14 along the central axis of the clinching tool, the free or lower end 10*c* of punch tip portion 10*b* contacts upper sheet 28 and, with continued downward movement, causes the adjacent material of sheets 28 and 30 to flow into the recess defined between tip 22*e* of pin 22 and the upper end 24*g* of bushing 24. This flowing movement, filling the inset defined by the pin, is seen in FIG. 1. As the punch continues downwardly and is best seen in FIG. 6, bushing halves 24*a* and 24*b* move radially outwardly relative to the central axis of the clinching tool under the resistance of collet fingers 20*d* to allow the adjacent material of sheets 28 and 30 to flow radially outwardly into the annular spaced defined by the retreating bushing halves. The radially outwardly flowing material also tends to flow downwardly around the sides of pin 22.

Punch 10 is programmed to move downwardly relative to pin 22 until it reaches a position in which punch lower end 10*c* is spaced from pin upper end 22*e* by a distance that is a major fraction of the combined initial thicknesses of sheets 28 and 30. For example, if sheets 28 and 30 have an initial combined thickness of 0.070 inches, the stop or final distance between ends 10*c* and 22*e* may be 0.040 inches. The joint 32 formed by the invention clinching tool includes an annular bead 32*e* which is clinched or folded back up against the undersurface of sheet 30 through a full 180° so as to be tightly pressed against the undersurface of sheet 30. Bead 32*a* is also extruded somewhat around the side surfaces of pin 22 so as to extend below the surface of the main body portion 32*b* of the joint to form a lip or coinage 32*c*. After the joint has been formed, punch 10 is moved upwardly and the joined sheets 28, 30 are separated from the lower end of the punch by the action of stripper 16. The joint formed by the clinching tool of the FIGS. 1–7 embodiment rigidly joins the sheets 28 and 30 together; has a low profile by virtue of the total folding of the lip 32*a* back up against the undersurface of lower sheet 30; has an aesthetically pleasing appearance; and is leak-proof since neither the material of upper sheet 28 nor the material of lower sheet 30 has been cut through in the clinching process. The joint formed by the clinching tool of the FIGS. 1–7 embodiment is particularly suited for joining relatively thick sheet material and may typically replace a rivet joint.

The clinching tool seen in FIG. 8 is generally similar to the clinching tool of the FIGS. 1–7 embodiment with the exception that the tool steel collet or collar 20 of the die 12 of the FIGS. 1–7 embodiment is replaced by a urethane sleeve 34 and the split bushing and pin are modified to accommodate the urethane sleeve. Specifically, the pin 36 includes a head portion 36*a*, a further reduced diameter head portion 36*b*, and a shank portion 36*c*; urethane sleeve 34 is received over head portion 36*b* and seats at its lower end on the shoulder 36*d* defined between pin head portions 36*a* and 36*b*; and split bushing 38 is positioned over pin shank portion 36*c* and within the upper end of urethane sleeve 34 with the upper end 36*e* of pin shank portion 36*c* inset with respect to the upper end 38*a* of split bushing 38.

The operation of the clinching of FIG. 8 is generally similar to the operation of the clinching tool of FIGS. 1–7 embodiment with the exception that the radial outward movement of the two halves of the split bushing is controllably resisted by the resilient expansion of urethane sleeve 34 rather than by the spring steel fingers 20*d* of collet 20. The joint formed by the FIG. 8 clinching tool is essentially similar to the joint formed by the clinching tool of the FIGS. 1–7 embodiment but, in general, is better suited for joining relatively thin sheet material and may typically replace a weld joint.

The die 12 of the clinching tool of the FIGS. 9 and 10 embodiment includes a collar or collet 40 and a pin 42.

Collet 40 is formed of tool steel and includes a base portion 40*a* defining a central axial passage 40*b* and a counterbore 40*c* in the lower end of the collet, and further includes a plurality of spring fingers 40*d* extending in cantilever fashion from base portion 40*a* in circumferentially spaced relation to the central axis of the clinching tool. The radially inner portions of fingers 40*d* are cut away to allow passage 40*b* to extend from end to end of the collet.

Pin 42 includes a head portion 42*a* received in counter bore 40*c* and a shank portion 42*b* passing upwardly through bored 40*b* and having its upper end 42*c* inset with respect to the upper end 40*e* of fingers 40*d*.

The joint 44 formed by the punching tool of FIGS. 9 and 10, as seen in FIG. 11, includes a plurality of finger or spike portions 44*a* formed by the extrusion of the material of sheets 28 and 30 into the spaces between adjacent fingers 40*d* during the clinching operation. In the clinching operation of the FIG. 9–11 embodiment, the fingers 40*d* of collet 40 move radially outwardly in response to downward movement of the punch to allow the material of sheets 28 and 30 to flow radially outwardly relative to the punch and the spaces between the fingers of the collet allow circumferentially spaced portions of the radially outwardly flowing material to move further radially outwardly into the spaces between the fingers to form the joint spikes or fingers 44*a*.

The joint 44 formed by the FIGS. 9–11 clinching tool is more resistant to rotation as between sheets 28 and 30 than the joints formed by the FIGS. 1–7 and FIG. 8 embodiments but is typically not leak proof since the material flowing outwardly into the spaces between the collet fingers has the effect of disrupting the surface continuity of the sheets.

Figure 12:
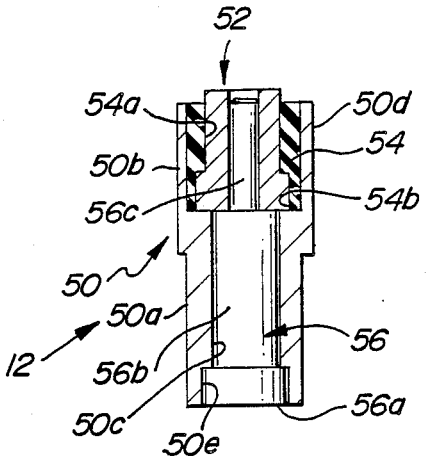
FIG. 12 is a somewhat schematic side elevational view in cross section of a fourth embodiment of a clinching tool according to the invention.
Figure 13:
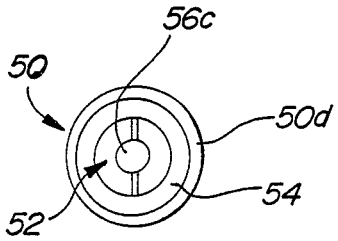
FIG. 13 is a top view of the clinching tool of FIG. 12.

The die 12 of the clinching tool of the FIGS. 12 and 13 embodiment includes an outer tubular member 50, an inner tubular member 52, a third tubular member 54 interposed concentrically between tubular members 50 and 52, and a pin 56.

Outer tubular member 50 is formed of tool steel and includes a lower portion 50*a*; an upper enlarged diameter portion 50*b*; and a central axial passage including a main passage portion 50*c*, an upper counter bore 50*d*, and a lower counter bore 50*e*.

Inner tubular member 52 comprises a split bushing and is substantially identical in construction to the split bushing of the FIGS. 1, 7, and 8 embodiments.

Member 54 is formed of a resilient material and defines a central passage 54*a* and a counter bore 54*b*.

Pin member 56 is identical to the pin member 22 employed in the FIG. 1–7 embodiment.

In the assembled relation of the clinching tool of the FIGS. 12 and 13 embodiment, the head portion 56*a* of the pin member is seated in counter bore 50*e* of outer tubular member 50; portion 56*b* of the pin member is slidably positioned within bore 50*c* of the outer tubular member; the upper shank portion 56*c* of the pin member is slidably positioned within the central passage of split bushing 52; and resilient bushing 54 is positioned within upper counter bore 50*d* of outer tubular member 50 and is interposed concentrically between the upper end of outer tubular member 50 and the split bushing 52.

In the operation of the clinching tool of the FIGS. 12 and 13 embodiment, resilient bushing 54 functions to allow split bushing 52 to expand radially outwardly during the clinching operation so as to allow the necessary radially outward material flow.

Figure 14:
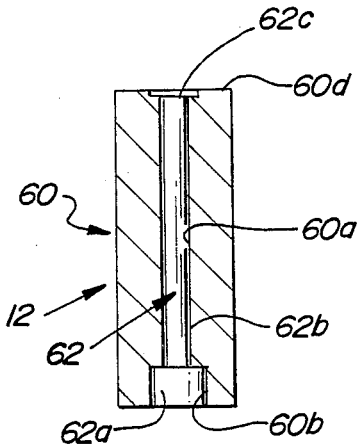
FIG. 14 is a somewhat schematic side elevational view in cross section of a fifth embodiment of a clinching tool according to the invention.
Figure 15:
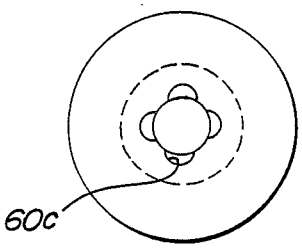
FIG. 15 is a top view of the clinching tool of FIG. 14.
Figure 16:
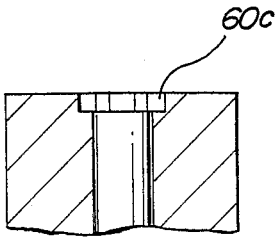
FIG. 16 is fragmentary cross-sectional view of the upper end portion of the clinching tool of FIG. 14.

The die 12 of the clinching tool of the FIGS. 14–16 embodiment includes a sleeve member 60 and a pin member 62.

Sleeve 60 is formed of a tool steel and defines a central passage including a main passage portion 60*a* and a lower counter bore 60*b*. The material at the upper end of sleeve member 12 is selectively cut away at circumferentially spaced locations around central passage 60*a* to define a circumferentially spaced series of clinch openings 60*c* communicating at their radially inner regions with passage 60*a* and also opening at the upper end of sleeve member 60.

Pin member 62 corresponds to the pin member of the FIGS. 9 and 10 embodiment and includes a head portion 62*a* and a shank portion 62*b*.

In the assembled relation of the clinching tool of the FIGS. 14–16 embodiment, head portion 62*a* of pin member 62 seats in counter bore 60*b* of sleeve 60 and pin member shank portion 62*b* is positioned slidably in central passage 60*a* of sleeve member 60 with its upper or free end 62*c* inset with respect to the upper end 60*d* of sleeve member 60 by an axial extent generally corresponding to the axial extent of cutouts or opening 60*c* so that the upper end 62*c* of the shank portion of the pin member directly underlies the openings 60*c*.

In the operation of the clinching tool of the FIGS. 14–16 embodiment, as the punch is moved downwardly into coacting relation with the anvil provided by the shank portion of the pin member, the material of the sheets to be joined flows downwardly into the inset defined between the top of the pin member and the top of the sleeve member and further flows radially outwardly into the clinch openings 60*c* to define a generally star shaped clinch joint.

The clinching tools of the invention will be seen to provide a clinched joint which is effective to rigidly join the sheets together and which presents a low profile and pleasing appearance. Further, the invention clinching tool, by virtue of its extreme simplicity, may be manufactured at very low cost as compared to prior art clinching tools and, still further, the invention clinching tool lends itself to ready repair in the event of failure of one or more of its components. Specifically, whereas prior art clinching tools are generally of the throw away variety requiring total replacement of the die assembly in the event of failure of one of the components of the die assembly, the components of the die assembly of the invention clinching tool may be individually and readily replaced in the event of component failure. Specifically, the collet, bushing, and pin components of the FIGS. 1–7 embodiment may be quickly, individually and inexpensively replaced in the event of component wear or failure; and the sleeve, bushing and pin components of the FIG. 8 embodiment, the collet and pin components of the FIGS. 9 and 10 embodiment and the FIGS. 14–16 embodiment, and the metal sleeve, resilient bushing, split bushing, and pin components of the FIGS. 12 and 13 embodiment may be similarly quickly and individually replaced. Further, by virtue of the simple modular design of the die assembly of the invention clinching tool, the clinching tool may be readily adapted for widely varying applications involving widely varying sizes and types of sheet material simply by replacing one or more of the components with components especially tailored to the parameters of the particular application in question.

Whereas preferred embodiments of the invention have been illustrated and described in detail, it will be apparent that various changes may be made in the disclosed embodiments without departing from the scope or spirit of the invention.

We claim:

1. A clinching tool for fastening two sheet of material together, said tool comprising:

(A) a punch adapted to be mounted in a punch retainer; and (B) a die including (1) a split bushing, (2) a collet including a base portion and a plurality of spring fingers extending in cantilever fashion from said base portion in circumferentially spaced relation to the axis of said punch to define a central axial passage aligned with said punch axis and including free end portions yieldably engaging circumferentially spaced locations on said bushing, (3) a pin member including a shank portion and a working end for coaction with said punch, (4) means mounting said pin member in said collet with said shank portion extending into said bushing and with said working end inset with respect to the end of said bushing adjacent said punch by a distance related to the thickness of the materials to be joined together, and (5) means precluding axial movement of said pin member within said collet in a direction toward said collet base portion.

2. A clinching tool for fastening two sheets of material together, said tool comprising:

(A) a punch adapted to be mounted in a punch retainer for movement along a punch axis; and (B) a die including (1) a die retainer defining an upwardly facing support surface, (2) a collet sized to be mounted on said retainer in axial alignment with said punch axis and including a base portion defining an annular downwardly facing surface proximate its lower end and a plurality of spring fingers extending in cantilever fashion from said base portion in circumferentially spaced relation to said punch axis to define a central axial passage aligned with said punch axis and including free end portions yieldably disposed about said axis adjacent said punch for outward movement in response to axial movement of said punch along a plurality of transverse axes; and (3) a separate pin member including a head portion and a reduced diameter shank portion extending upwardly from said head portion and forming an upwardly facing annular shoulder surface at the juncture therewith, said pin member being sized to be positioned on said die retainer with the lower face of said head portion seating on said die retainer support surface, said shank portion extending upwardly in said central axial collet passage and terminating at a location proximate said free end portions of said spring fingers, and said annular downwardly facing base portion surface seating on said upwardly facing pin member annular shoulder surface to preclude axial movement of said pin member within said collet upon downward axial movement of said punch for coaction with said die.

3. A clinching tool according to claim 2 wherein:

(C) said die retainer defines an upwardly opening cavity including a bottom wall defining said support surface; and (D) said collet is positioned in said cavity.

4. A clinching tool according to claim 2 wherein:

(C) said central axial passage includes a central axial bore in said collet base portion sized to slidably receive said pin shank portion and a downwardly opening counter bore in said lower end of said collet base portion sized to receive said pin head portion; and (D) said annular downwardly facing surface is defined by the shoulder defined at the juncture of said central bore and said counter bore.

5. A clinching tool for fastening two sheets of material together, said tool comprising:

(A) a punch adapted to be mounted in a punch retainer for movement along a punch axis; and (B) a die including (1) a die retainer, (2) a collet adapted to be mounted on said retainer in axial alignment with said punch axis and including a base portion and a plurality of spring fingers extending in cantilever fashion from said base portion in circumferentially spaced relation to said punch axis to define a central axial passage aligned with said punch axis and including free end portions yieldably disposed about said axis adjacent said punch for outward movement in response to axial movement of said punch along a plurality of transverse axes, (3) a split bushing positioned within said free end portions of said fingers, (4) a separate pin member sized to be positioned in said central axial passage and inset with respect to the end of said bushing adjacent said punch by a distance related to the thickness of the material to be joined together, (5) means removably mounting said pin member in said axial passage coaxial with said punch axis, and (6) means precluding axial movement of said pin member within said collet in a direction towards said collet base portion.

* * * * *